US005372096A

United States Patent [19]

Skowyra

[11] Patent Number: 5,372,096

[45] Date of Patent: Dec. 13, 1994

[54] INTERNAL PARTICLE COLLECTING CELLS FOR CIRCULATING FLUID BED COMBUSTION

[75] Inventor: Richard S. Skowyra, Feeding Hills, Mass.

[73] Assignee: Combustion Engineering, Inc., Windsor, Conn.

[21] Appl. No.: 176,346

[22] Filed: Dec. 29, 1993

[51] Int. Cl.[5] ..... F22B 1/00

[52] U.S. Cl. ..... 122/4 D; 165/104.16; 422/145; 422/146

[58] Field of Search ..... 122/4 D; 110/245; 165/104.16; 422/145, 144

[56] References Cited

U.S. PATENT DOCUMENTS 4,951,612 8/1990 Gorzegno ..... 122/4 D
5,167,932 12/1992 Ruottu ..... 122/4 D X
5,171,542 12/1992 Sarkomaa ..... 422/146
5,277,151 1/1994 Paulhamus ..... 122/4 D

FOREIGN PATENT DOCUMENTS

WO87/05826 10/1987 WIPO .
WO87/07356 12/1987 WIPO .
WO90/05020 5/1990 WIPO .

*Primary Examiner*—Edward G. Favors
*Attorney, Agent, or Firm*—Chilton, Alix & Van Kirk

[57] ABSTRACT

The particle separation and collection system for a circulating fluidized bed combustion system is incorporated inside of the combustor. One or more particle collecting cells are formed along one of the waterwalls of the combustor with the walls of the cells also being water cooled. The cells may contain heat exchange surface and means are provided at the bottom of each cell to control the flow of particles from the cells back into the combustor.

5 Claims, 3 Drawing Sheets

INTERNAL PARTICLE COLLECTING CELLS FOR CIRCULATING FLUID BED COMBUSTION

BACKGROUND OF THE INVENTION

The present invention relates to a circulating fluidized bed combustion system and particularly to a system for separating and returning the solid particles to the combustor.

One of the main features of fluidized bed combustion is the ability to burn high-sulfur fuels in an environmentally acceptable manner without the use of flue-gas scrubbers. In fluidized bed combustion, much of the sulfur contained in the fuel is removed during the combustion by a sorbent material in the fluid bed, usually limestone.

One type of fluidized bed combustion is the circulating fluidized bed system. In this system, the gas velocities in the combustor are three to four times as high as in a bubbling fluidized bed system. The small solid particles of limestone are carried up through and out of the combustor and a uniform lower-density gas/solids mixture exists throughout the entire system. Since the solids move through the system at a lower velocity than the gases, significant solids residence times are obtained. The long residence time coupled with the small particles size produce high combustion efficiency and high sulfur oxide removal with lower sorbent limestone feed.

In a circulating fluidized bed combustion system, the solids which are carried from the combustor are separated from the gas and returned to the combustor. Normally, this has been accomplished by cyclone separators which are external from the combustor and connected by a horizontal gas pass. These cyclone separators have been water cooled, steam cooled or refractory lined. These external cyclone separators require considerable building space and create differential thermal expansion problems among the combustor, the horizontal gas pass and the cyclones.

SUMMARY OF THE INVENTION

An object of the present invention is to incorporate the particle separation system of a circulating fluidized bed combustion system in with the combustor and recirculate the particles directly to the combustor.

DESCRIPTION OF THE PREFERRED EMBODIMENT

Figure 1:
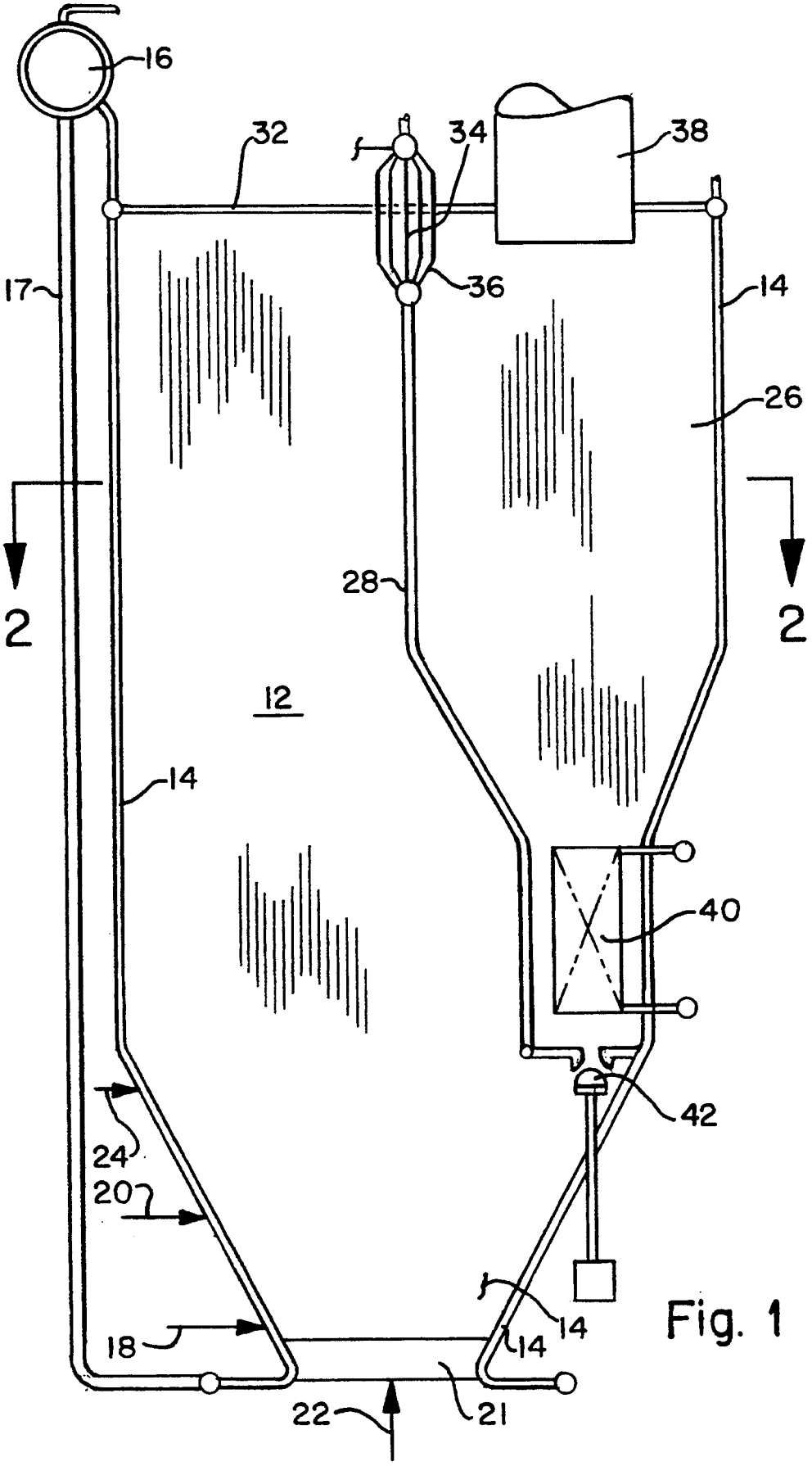
FIG. 1 is a simplified elevation view of a circulating fluidized bed combustion system incorporating the particle separation and recycle system of the present invention.
Figure 2:
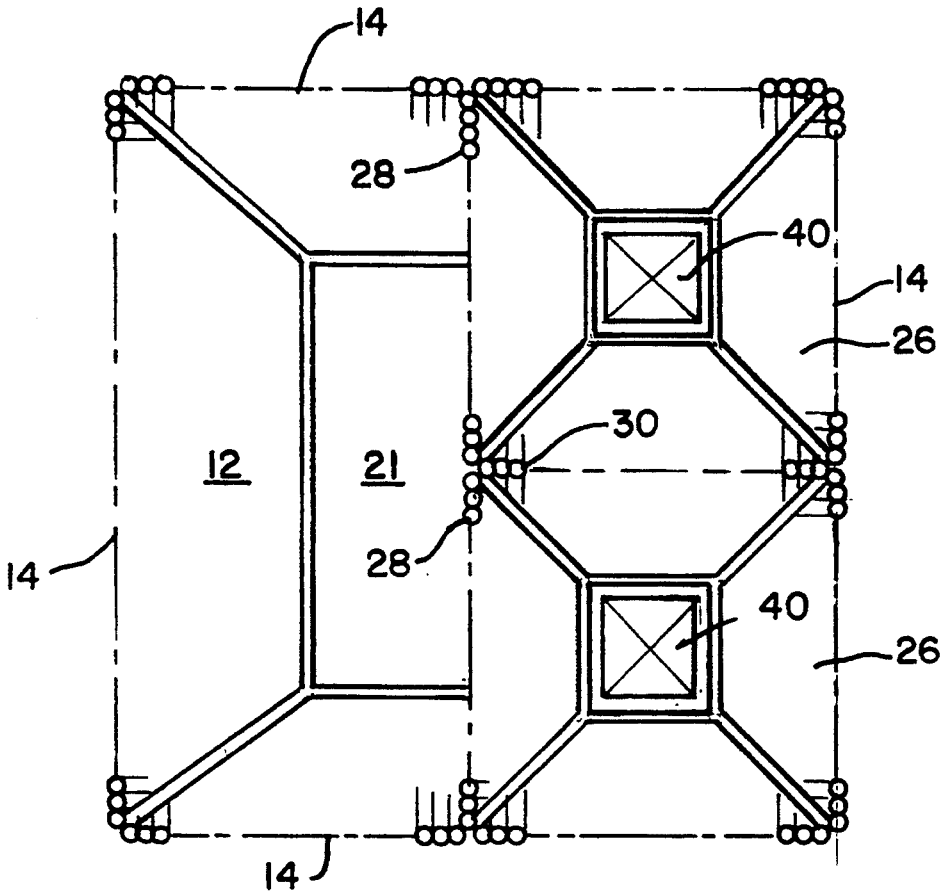
FIG. 2 is a cross section view taken along line 2—2 of FIG. 1.

Referring to FIG. 1, a circulating fluidized bed combustion system is illustrated including combustor 12 with waterwalls 14. These waterwalls 14 define the combustor enclosure and line the entire structure. As the name implies, the waterwalls are a part of the steam generating circuit in which water is converted to saturated steam. The steam passes from the waterwalls to the steam drum 16 from which steam is separated from water and passed to the superheater (not shown). The water from the steam drum 16 is then recycled back to the waterwalls in downcomer 17.

Coal is fed to the combustor 12 at 18 while the limestone is injected at 20. The primary, fluidizing air is fed to the air plenum chamber 21 in the bottom of the combustor at 22 while secondary combustion air is fed at 24.

In a circulating fluidized bed combustion system, the solids are carried along with the flue gases up and out of the combustor. These solids, which contain significant quantities of unreacted limestone and fuel, are separated from the flue gases and recycled to the combustor. In the present invention, this separation is accomplished in the separation cells 26 which are internal to the combustor 12. This contrasts from the conventional separators which are external from the combustor and are connected by a duct. In the drawings, two separation cells 26 have been illustrated but there could be just one cell or more than two. Each cell 26 is formed by waterwalls which form a part of the steam generating circuit of the steam generator. As shown in the drawings, the waterwalls of the cells are partially formed by the waterwalls 14 of the combustor 12. The remainder are formed by the cell-forming waterwall 28 and the cell division waterwall(s) 30.

The upper ends of the cell-forming waterwall 28 and the cell division waterwall(s) 30 terminate below the roof 32 of the combustor forming a passage 34 from the main portion of the combustor into the space above the separation cells. As shown, the cell-forming waterwall 28 may be suspended by heat exchange surface 36 which passes up through this passage 34. The flue gases and suspended solids flow through this passage 34 into the space above the cells. The vast majority of the particles of 15 micrometers or greater drop out of the flue gas stream down into the cells while the flue gas and the finer particles are discharged through the outlet duct 38. The collected particles drop down through each of the cells and transfer a portion of their heat to the waterwalls of the cells. The waterwalls of the cells may be coated with materials to reduce erosion or corrosion of the cell walls.

Located in a portion of each cell may be heat exchange surface 40 such as evaporation superheat and reheat surface. This heat exchange surface is constructed and configured such that it does not impede the flow of the solids out of the bottom of each cell back into the lower portion of the combustor. Also, at the base of each cell may be a device to regulate the return flow of the collected particles. This device also forms a pressure seal between the high pressure in the combustor and the lower pressure in the cells.

Figure 3:
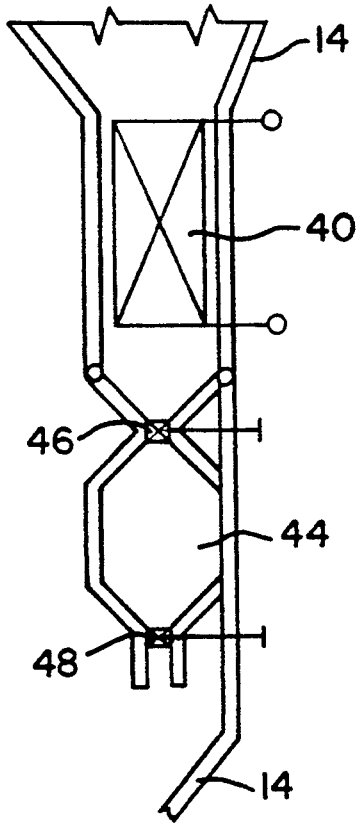
FIG. 3 is a view of the bottom of a particle collecting cell illustrating a modified particle flow control means.
Figure 4:
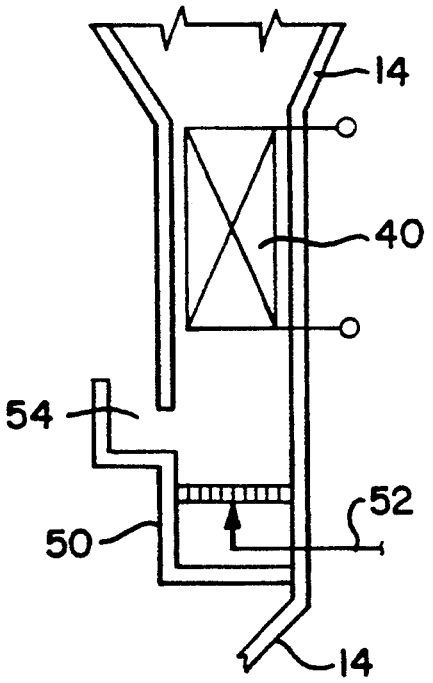
FIG. 4 is another modification of the particle flow control means.

In FIG. 1, this device comprises a water cooled ash discharge valve 42 which is reciprocated up and down to vary the opening out the bottom of the cell. The build-up of solids in each cell forms the pressure seal. FIG. 3 illustrates another type of seal which could be employed for batch discharge comprising a pressure vessel 44 with inlet and outlet valves 46 and 48 respectively. A further option would be the seal pot type of arrangement 50 shown in FIG. 4 in which air fluidization 52 controls the discharge flow of solids out through the overflow channel 54.

The use of the internal particle collections cells of the present invention requires less building space, improves the efficiency of the entire unit because of less heat loss, increases the start-up rate also because of less heat loss and minimizes the problems caused by thermal expansion.

I claim:

1. A circulating fluidized bed combustion system comprising a combustor having four water-cooled walls, means for introducing fuel and sorbent into the lower portion of said combustor, means for introducing fluidizing combustion air into the bottom of said combustor and flue gas outlet means in the top of said combustor, wherein the improvement comprises at least one particle collecting cell located inside of said combustor along one of said four combustor walls below said flue gas outlet means, said particle collecting cell having water-cooled walls defining said cell, a particle outlet opening in the bottom of said cell for returning separated particles to said lower portion of said combustor, heat exchange means located in said cell for extracting heat from said collected particles and means for controlling the rate of flow of particles through said outlet opening.

2. A circulating fluidized bed combustion system as recited in claim 1 wherein one of said four water-cooled combustor walls comprises one side of said cell.

3. A circulating fluidized bed combustion system as recited in claim 1 including a plurality of said particle collecting cells located along said one combustor wall.

4. A circulating fluidized bed combustion system as recited in claim 1 wherein said means for controlling the rate of flow of particles comprises a water cooled discharge valve.

5. A circulating fluidized bed combustion system as recited in claim 1 wherein said means for controlling the rate of flow of said particles comprises a pressure vessel attached to said cell through an inlet valve and including an outlet valve for controlling the discharge of particles from said pressure vessel to said combustor.

* * * * *